United States Patent [19]

Takamizawa et al.

[11] 4,370,365

[45] Jan. 25, 1983

[54] METHOD FOR IMPARTING WATER-REPELLENCY TO WOVEN FABRICS

[75] Inventors: Minoru Takamizawa; Akira Abe; Katsusuke Kasahara, all of Annaka; Yukito Komeno, Fukui; Akira Aoyama, Takefu, all of Japan

[73] Assignees: Shin-Etsu Chemical Co., Ltd., Tokyo; Agehara Orimono Kogyo K.K., Fukui, both of Japan

[21] Appl. No.: 312,828

[22] Filed: Oct. 19, 1981

[30] Foreign Application Priority Data

Oct. 21, 1980 [JP] Japan ..... 55-147334

[51] Int. Cl.[3] ..... B05D 3/02

[52] U.S. Cl. ..... 427/387; 156/329; 427/208.2; 427/393.4; 428/266; 524/588; 524/862; 528/18; 528/19; 528/31; 528/32

[58] Field of Search ..... 528/18, 19, 31, 32; 524/862, 588; 427/387, 393.4, 208.2; 428/261, 266; 156/329

[56] References Cited

U.S. PATENT DOCUMENTS 3,418,162 12/1968 Adachi ..... 524/588 X 3,528,940 9/1970 Modic ..... 524/588 X

*Primary Examiner*—Thurman K. Page

*Attorney, Agent, or Firm*—Toren, McGeady and Stanger

[57] ABSTRACT

The invention provides a novel method for imparting water-repellency to a woven fabric such as velveteen by use of a silicone-based water-repellent agent. In addition to water-repellency, the fabric treated by the inventive method has many excellent characteristics required in a fancy fabric as well as susceptibility to bonding with a lining cloth by use of a hot-melt adhesive. The water-repellent agent used in the method comprises, in addition to an organohydrogenpolysiloxane, either one or a combination of a linear organopolysiloxane, in which at least 5% by moles of the organic groups are alkenyl, e.g. vinyl, groups, and a resinous organopolysiloxane composed of the monofunctional organosiloxane units and tetrafunctional siloxane units $SiO_2$ in a limited molar proportion.

15 Claims, No Drawings

METHOD FOR IMPARTING WATER-REPELLENCY TO WOVEN FABRICS

BACKGROUND OF THE INVENTION

The present invention relates to a novel silicone-based water-repellent agent capable of imparting excellent water-repellency to various kinds of woven fabrics and a method for imparting excellent water-repellency therewith to various kinds of woven fabrics. In particular, the method is useful for the water-repellent treatment of velveteen or the like fabrics with splicing wool in the warps or woofs and the thus treated fabrics nevertheless have good and reliable susceptibility to adhesive bonding of lining cloth and the like by use of a hot-melt adhesive.

As is well known, various kinds of water-repellent agents formulated with silicone materials, i.e., organopolysiloxane compounds, are currently in use for imparting water-repellency to woven and non-woven fabrics. Principal silicone component in most of these silicone-based water-repellent agents in the prior art is a methylhydrogenpolysiloxane and very excellent water-repellency is imparted to the fabrics treated therewith. Unfortunately, fabrics treated with a methylhydrogenpolysiloxane-based water-repellent agent are disadvantageously less susceptible to adhesive bonding of other cloths, in particular, by use of a hot-melt adhesive in addition to the acquisition of undesirable properties of increased stiffness and poor feeling of the treated fabrics. Although such silicone-treated fabrics have no particular problems in working with sewing machines, drawbacks are unavoidable when such silicone-treated fabrics are worked by integrally bonding lining or interlining cloths by use of a hot-melt adhesive with the object to save labor and time, because the once bonded cloth is readily separated from the silicone-treated fabric by the loss of adhesion owing to the releasability inherent to the silicones.

Several attempts have been made in two ways to solve the above mentioned problems in the silicone-treated water-repellent fabrics. First of the approaches is the modification of the hot-melt adhesive used in adhesive bonding of such a silicone-treated fabric. For example, an improved hot-melt adhesive is proposed in Japanese Patent Kokai No. 54-149741 which is a composition comprising a polyolefin resin to which an organosilane compound having a hydrolyzable group along with hydrocarbon groups is graft-copolymerized and a catalyst for the silanol condensation. The hot-melt adhesives of this type have relatively low strength of adhesion and are disadvantageously less resistant against deterioration by dry cleaning.

As the second approach, the fabric, having been treated with a silicone-based water-repellent agent, is subsequently treated with a carbon-functional silane or a silicone-based primer to improve the adhesive strength with a hot-melt adhesive. This method is sometimes effective but causes a problem since specific facilities are required for the priming treatment leading to a considerable increase in the costs for the facilities and for the process steps in addition to a fatal defect of bad feeling of the primer-treated fabrics.

SUMMARY OF THE INVENTION

An object of the present invention is, therefore, to provide a novel and improved silicone-based water-repellent agent and a method suitable for imparting high water-repellency to woven fabrics freed from the above described problems of the prior art silicone-based water-repellent agents and the methods of use thereof which resulted in the degraded feeling of the treated fabrics as well as the poor susceptibility to bonding with a hot-melt adhesive.

The silicone-based water-repellent agent provided by the present invention, which is preferably in the form of an aqueous emulsion, comprises, as the silicone ingredients thereof, (a) from 10 to 90% by weight of an organohydrogenpolysiloxane containing, in a molecule, at least one siloxane unit represented by the formula $$R^1{}_aH_bSiO_{(4-a-b)/2}, \quad (I)$$

in which $R^1$ denotes a monovalent hydrocarbon group having from 1 to 30 carbon atoms, a is a number of 0, 1 or 2 and bis a number of 1 or 2 with the proviso that a+b is equal to 1, 2 or 3, and (b) from 90 to 10% by weight of either one or a combination of the organopolysiloxanes (b-1) and (b-2), the organopolysiloxane (b-1) being an alkenyl group-containing diorganopolysiloxane expressed by the average unit formula $$R^2{}_cSiO_{(4-c)/2}, \quad (II)$$

in which $R^2$ denotes a monovalent hydrocarbon group, at least 5% by moles of the monovalent hydrocarbon groups denoted by $R^2$ being alkenyl groups, and c is a positive number from 1.95 to 2.02 inclusive, and the organopolysiloxane (b-2) being a resinous organopolysiloxane composed of the monofunctional siloxane units represented by the general formula $$R^3{}_3SiO_{0.5}, \quad (III)$$

in which $R^3$ denotes a monovalent hydrocarbon group having from 1 to 6 carbon atoms, and the tetrafunctional siloxane units expressed by the formula $SiO_2$, the molar ratio of the monovalent siloxane units to the tetrafunctional siloxane units, i.e. $R^3{}_3SiO_{0.5}/SiO_2$, being in the range from 0.4:1 to 1.2:1.

Accordingly, the method of the present invention for imparting water-repellency to a woven fabric comprises soaking the woven fabric in the water-repellent agent as defined above, preferably, in a form of an aqueous emulsion followed by drying and then subjecting the thus dried fabric to a heat treatment.

The water-repellent fabrics, such as, velveteen obtained according to the method of the present invention, can retain their inherent soft feeling before treatment and have good susceptibility to bonding with a hot-melt adhesive. The adhesive bonding between the thus treated fabric and a lining cloth or the like with a hot-melt adhesive is very durable over a long period of time and extremely strongly resistant against degradation by dry cleaning. In addition, the fabric treated according to the inventive method is highly resistant against slippage of the threads, thus exhibiting good performance in sewing works. Therefore, the present invention provides a means to impart water-repellency to those fabrics, such as velveteen and the like, with which considerable difficulties are encountered in sewing and draping and other high-level qualities, e.g. recovery of piles, behavior in compression and the like which are essential requirements.

DETAILED DESCRIPTION OF THE PREFERRED EMBODIMENTS

In the following, detailed descriptions are given for each of the organopolysiloxanes (a), (b-1) and (b-2) as the basic ingredients of the inventive water-repellent agent.

The organohydrogenpolysiloxane as the component (a) must have at least one of the siloxane units represented by the general formula (I) above in a molecule. In the formula, $R^1$ is a monovalent hydrocarbon group having from 1 to 30 carbon atoms as exemplified by alkyl groups, such as, methyl, ethyl, propyl and butyl groups, cycloalkyl groups, such as, cyclopentyl and cyclohexyl groups, alkenyl or alkenyl-containing groups, such as, vinyl, allyl, acrylic, methacrylic and butadienyl groups, aryl groups, such as, phenyl and tolyl groups, and aralkyl groups such as, benzyl group as well as those substituted groups obtained by the substitution of halogen atoms and other substituent atoms or groups for part or all of the hydrogen atoms in the above named hydrocarbon groups. The group $R^1$ is preferably a methyl group.

The suffixes a and b are each a number as defined above so that the organohydrogenpolysiloxane must contain at least one hydrogen atom directly bonded to the silicon atom in a molecule.

Accordingly, the organohydrogensiloxane units of the general formula (I) include, taking a methyl group denoted by Me as the hydrocarbon group $R^1$, methylhydrogensiloxane unit MeHSiO, dimethylhydrogensiloxane unit $Me_2HSiO_{0.5}$, methyl(dihydrogen)siloxane unit $MeH_2SiO_{0.5}$ and the like. Preferred organohydrogenpolysiloxanes as the component (a) are mainly composed of the difunctional (monohydrocarbyl)hydrogensiloxane units or, in particular, methylhydrogensiloxane units mentioned above so that the organohydrogenpolysiloxane has a substantially linear molecular structure.

Although the linear molecular structure is preferable as mentioned above, there may be contained a small number of the tetrafunctional siloxane units $SiO_2$ in the molecules provided the molecular structure is not unduly three-dimensional. At any rate, the molecular chain ends of the molecules are blocked preferably with trihydrocarbylsilyl groups such as trimethylsilyl groups and, when the molecular structure is linear, the organohydrogenpolysiloxane has a viscosity of at least 5 centistokes at 25° C. although the degree of polymerization thereof is not particularly limitative.

The method for the preparation of such an organohydrogenpolysiloxane is well known in the art of silicones so that no detailed description is necessary therefor over a mere statement that the organohydrogenpolysiloxane is readily obtained by the (co)hydrolysis of one or a combination of the organochlorosilanes having silicon-bonded hydrogen atoms such as an organodichlorosilane, e.g. methyldichlorosilane, diorganochlorosilane, e.g. dimethylchlorosilane, monoorganochlorosilane, e.g. methyl monochlorosilane, and the like with optional combination of other organochlorosilanes such as trimethylchlorosilane and the like followed by the (co)condensation of the hydrolysis product.

The weight proportion of this component (a) is from 10 to 90% based on the total amount of the component (a) and components (b-1) and/or (b-2).

The essential requirement in the present invention is that the above defined organohydrogenpolysiloxane is used as component (a) in combination with either one or both of the other organopolysiloxanes defined above as components (b-1) and (b-2). The weight proportion of these components (b-1) and (b-2) is from 90 to 10% based on the total amount of the component (a) and components (b-1) and/or (b-2).

The component (b-1), is an organopolysiloxane of the composition expressed by the average unit formula (II) above, in which $R^2$ is a monovalent hydrocarbon group exemplified by those given above as the examples of the monovalent hydrocarbon groups denoted by $R^1$. It is important in this component (b-1) that at least 5% by moles of the groups denoted by the symbol $R^2$ should be alkenyl groups such as vinyl and allyl groups, preferably vinyl groups, since otherwise no good susceptibility to the bonding with a hot-melt adhesive is obtained.

As is understood from the value of the suffix c in the average unit formula (II) which is close to 2, the organopolysiloxane as the component (b-1) has substantially a linear molecular structure. In other words, the component (b-1) is preferably a diorganopolysiloxane such as a dimethylpolysiloxane with substitution of vinyl groups for part of the methyl groups.

The component (b-2), on the other hand, is a resinous organopolysiloxane composed of the monofunctional organosiloxane units expressed by the general formula (III) and the tetrafunctional siloxane units $SiO_2$. In the general formula (III), $R^3$ denotes a monovalent hydrocarbon group having from 1 to 6 carbon atoms exemplified by alkyl groups such as methyl, ethyl, propyl and butyl groups, alkenyl groups such as vinyl and allyl groups and aryl groups such as phenyl group as well as those substituted groups obtained by the substitution of halogen atoms or other substituent atoms or groups for part or all of the hydrogen atoms in the above named hydrocarbon groups.

Several of the examples of the monofunctional siloxane units of the general formula (III) are; $Me_3SiO_{0.5}$, $Et_3SiO_{0.5}$, $Pr_3SiO_{0.5}$, $Me_2ViSiO_{0.5}$, $Ph_3SiO_{0.5}$ and $Me_2PhSiO_{0.5}$, in which the symbols Me, Et, Pr, Vi and Ph each denote methyl, ethyl, propyl, vinyl and phenyl groups, respectively.

The molar ratio of the monofunctional siloxane units to the tetrafunctional siloxane units, i.e. the molar ratio of $R^3{}_3SiO_{0.5}/SiO_2$, in the resinous organopolysiloxane (b-2) should be in the range from 0.4:1 to 1.2:1 or, preferably, from 0.5:1 to 0.8:1. This is because an excessively large content of the $SiO_2$ units may result in the increased stiffness of the fabric treated with the water-repellent agent formulated with the resinous organopolysiloxane while a water-repellent agent formulated with a resinous organopolysiloxane with smaller content of the $SiO_2$ units is detrimental to the susceptibility of the treated fabric to bonding with a hot-melt adhesive.

It should be noted that the resinous organopolysiloxane as the component (b-2) may contain small amounts of diorganosiloxane units provided that the above mentioned limitation in the molar ratio of the monofunctional to tetrafunctional siloxane units is satisfied.

The blending proportion of the component (a) and the component or components (b-1) and/or (b-2) in the invention water-repellent agent should be such that from 90 to 10% or, preferably, from 80 to 30% by weight of the former is taken per from 10 to 90% or, preferably, from 20 to 70% by weight of the latter. When both of the components (b-1) and (b-2) are used in combination, from 10 to 40% by weight and from 90 to 60% by weight of the former and the latter, respectively, should be combined based on the total amount of them.

The water-repellent agent of the present invention is readily prepared by dissolving the above mentioned components (a) and (b-1) and/or (b-2) in a suitable organic solvent or by dispersing them in water to form an aqueous emulsion by use of a suitable emulsifying agent. Preferably, the water-repellent agent should be in the form of an aqueous emulsion when the disadvantages inherent to the use of an organic solvent should be avoided.

The water repellent agent of the invention is usually admixed with a metal salt of an organic acid such as dibutyltin dilaurate, zinc octoate and the like as the catalyst. The amount of these metal salts in the water-repellent agent is preferably in the range from about 2 to about 10% by weight based on the total amount of the components (a) and (b-1) and/or (b-2). These metal salts may be used either alone or as a combination of two kinds or more according to need.

When a woven fabric is treated and imparted with water-repellency according to the invention, the water-repellent agent prepared as described above is applied to the fabric by a suitable method such as dipping in the solution or aqueous emulsion of the water-repellent agent or spraying with the solution or emulsion followed by, if necessary, squeezing, drying and heat treatment carried out at a temperature of 150° to 180° C. for 1 to 3 minutes.

In the following, several examples are given for the formulation and preparation of water-repellent agents all in the form of an aqueous emulsion as well as for the treatment of a fabric therewith along with the effects of water-repellency and other properties imparted to the fabric treated with the water-repellent agent. In the examples, the meaning of the symbols Me, Vi and Ph is the same as given before.

EXAMPLE 1

Preparation of water-repellent agents A to H

Preparation A. An aqueous emulsion was prepared by vigorously agitating a mixture composed of 150 g of a methylhydrogenpolysiloxane terminated at both molecular chain ends with trimethylsilyl groups and having a viscosity of 50 centistokes at 25° C., 150 g of a methylvinylpolysiloxane terminated at both molecular chain ends with silanolic hydroxy groups and expressed by the structural formula

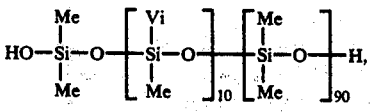

5 g of polyoxyethylene octyl phenol ether and 695 g of water.

Preparation B. An aqueous emulsion was prepared by vigorously agitating a mixture composed of 150 g of a methylhydrogenpolysiloxane expressed by the structural formula

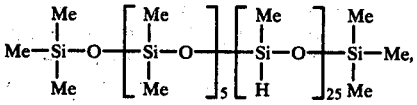

150 g of a methylvinylpolysiloxane expressed by the structural formula

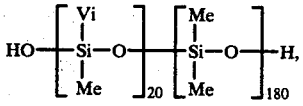

5 g of polyoxyethylene octyl phenol ether and 695 g of water.

Preparation C. An aqueous emulsion was prepared by vigorously agitating a mixture composed of 60 g of the same methylhydrogenpolysiloxane as used in Preparation A, 480 g of a toluene solution containing 50% by weight of a resinous organopolysiloxane composed of $Me_3SiO_{0.5}$ units and $SiO_2$ units in a molar ratio of 0.65:1, 5 g of polyoxyethylene octyl phenol ether and 455 g of water.

Preparation D. An aqueous emulsion was prepared by vigorously agitating a mixture composed of 240 g of the same methylhydrogenpolysiloxane as used in Preparation A, 30 g of the same methylvinylpolysiloxane as used in Preparation A, 60 g of the same toluene solution of the resinous organopolysiloxane as used in Preparation C, 5 g of polyoxyethylene octyl phenol ether and 665 g of water.

Preparation E. An aqueous emulsion was prepared by vigorously agitating a mixture composed of 100 g of the same methylhydrogenpolysiloxane as used in Preparation A, 100 g of a methylvinylpolysiloxane expressed by the structural formula

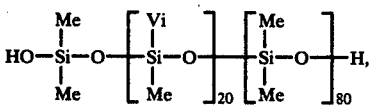

200 g of a toluene solution containing 50% by weight of a resinous organopolysiloxane composed of $Me_2ViSiO_{0.5}$ units and $SiO_2$ units in a molar ratio of 1:1, 5 g of polyoxyethylene octyl phenol ether and 365 g of water.

Preparation F. An aqueous emulsion was prepared by vigorously agitating a mixture composed of 100 g of the same methylhydrogenpolysiloxane as used in Preparation A, 50 g of the same methylvinylpolysiloxane as used in Preparation A, 100 g of the same toluene solution of the resinous organopolysiloxane as used in Preparation E, 50 g of a toluene solution containing 50% by weight of a resinous organopolysiloxane composed of 10% by moles of $PhSiO_{1.5}$ units, 20% by moles of $MeSiO_{1.5}$ units and 70% by moles of $Me_2SiO$ units, 50 g of a methylphenylpolysiloxane terminated at both molecular chain ends with trimethylsilyl groups and having a viscosity of 100 centistokes at 25° C., 5 g of polyoxyethylene octyl phenol ether and 645 g of water.

Preparation G. An aqueous emulsion was prepared by vigorously agitating a mixture composed of 300 g of the same methylhydrogenpolysiloxane as used in Preparation A, 5 g of polyoxyethylene octyl phenol ether and 695 g of water.

Preparation H. An aqueous emulsion was prepared by vigorously agitating a mixture composed of 150 g of the same methylhydrogenpolysiloxane as used in Preparation A, 150 g of a dimethylpolysiloxane terminated at both molecular chain ends with silanolic hydroxy groups and having a viscosity of 200 centistokes at 25° C., 5 g of polyoxyethylene octyl phenol ether and 695 g of water.

Each of the above prepared aqueous emulsions A to H was admixed with an aqueous emulsion containing 30% by weight of zinc octoate and a water-soluble melamine resin in such amounts that the concentration of each of the zinc octoate and melamine resin in the finished aqueous emulsion was 3% by weight. These finished emulsion were used as the water-repellent agents A to H.

EXAMPLE 2

A rayon fabric of velveteen was dipped in either one of the aqueous emulsions as the water-repellent agent prepared in Example 1 followed by squeezing and heat treatment first at 100° C. for 3 minutes and then at 160° C. for 3 minutes to be imparted with water-repellency.

The thus treated fabrics were examined for the water repellency, feeling, slip strength of seam, i.e. resistance against slippage of threads, crush point and drape factor as well as the susceptability to bonding with a hot-melt adhesive. The procedures for testing were as described below.

Water repellency: Measurements were undertaken according to the procedure specified in JIS L 1079.

Feeling: The feeling of the fabric obtained by touching with bare hands was evaluated organoleptically in two grades of "Good" for the soft and pleasant feeling of the treated fabric and "No good" for the hard and unpleasant feeling.

Slip strength of seam: Test pieces of 10 cm×5 cm were taken by cutting the treated fabric with the longer side in the direction of warp or woof. The thread running at about 0.5 cm from the periphery of the shorter side of each of the pieces was cut and two of the thus treated pieces were sewed together with the right sides facing each other along the line 0.5 cm apart from the periphery of the shorter side where the thread had been cut with a sewing machine in a lock stitch. The conditions for sewing were as follows.

Machine sewing thread:
#30 polyester filament yarn
Sewing needle:
#14
Machine pitch:
16 needles/3 cm
Margin to sew-up:
0.5 cm
Tension of threads:
tension of the lower thread 15 g with the tension of the upper thread balanced therewith Fraying of the threads was prevented by making knots at the ends thereof.

Each of the thus prepared test specimens was pulled apart in an automatic tensile tester by gripping each of the pieces at a distance 5 cm apart from the seam line and pulling at a velocity of 20 cm/minute until the marginal portions were torn off. The strength was the maximum load in this pulling procedure in kg as an average value of 5 times of measurements.

Crush point: The fabric of velveteen was subjected to an continuously increasing compressive load in a tester for compressive elasticity up to the largest load of 3 kg/cm$^2$ with the initial load of 10 g/cm$^2$ to determine the compression resistance at the yield of the piles of the fabric.

Drape factor: According to the drape-tester method, a disk stand of 12.7 cm diameter was covered with a test specimen of 25.4 cm diameter taken from the fabric and the drape factor was calculated from the contour of the vertical projection of the test piece.

Adhesive bonding: The treated fabric and an interlining cloth of non-woven fabric spotted dot-wise with a hot-melt adhesive resin which was a modified copolymer of vinyl chloride and vinyl acetate were bonded together by hot pressing with an iron at 150° C. for 15 seconds under a pressure of 0.3 kg/cm$^2$. A peeling test was undertaken with a 2.5 cm wide strip taken from the above prepared lamination of the velveteen and the non-woven fabric in a pulling direction of 180° C. by use of an automatic tensile tester. The measurements were performed either with the test strip as prepared or with the test strip after 3 times of dry cleaning.

The results of the above measurements are summarized in the table below. In the table, the results with the water-repellent agents G and H are for comparative purpose.

TABLE

| Water-repellent agent | | A | B | C | D | E | F | G | H |
|---|---|---|---|---|---|---|---|---|---|
| Water repellency | | 100 | 100 | 100 | 100 | 100 | 100 | 100 | 80 |
| Feeling | | Good | Good | Good | Good | Good | Good | No good | Good |
| Slip strength of seam, kg | | 13.0 | 12.6 | 14.8 | 12.9 | 15.2 | 15.0 | 4.5 | 5.0 |
| Crush point, kg | | 1.4 | 1.3 | 1.4 | 1.4 | 1.4 | 1.4 | 1.0 | 1.2 |
| Drape factor, % | | 40.2 | 41.3 | 41.9 | 39.8 | 36.9 | 40.0 | 65.0 | 50.8 |
| Adhesive bonding, g | As prepared | 390 | 370 | 600 | 300 | 550 | 600 | 80 | 60 |
| | after dry cleaning | 700 | 600 | 780 | 520 | 680 | 780 | 50 | 50 |

What is claimed is:

1. A silicone-based water-repellent agent for imparting water-repellency to a woven fabric which comprises, as the silicone ingredient thereof:

from 10 to 90% by weight of a component (a) which is an organohydrogenpolysiloxane containing, in a molecule, at least one organohydrogensiloxane unit represented by the general formula $$R^1_aH_bSiO_{(4-a-b)/2},$$

in which $R^1$ denotes a monovalent hydrocarbon group having from 1 to 30 carbon atoms, a is a number of 0, 1, or 2 and b is a number of 1 or 2 with the proviso that a+b is equal to 1, 2 or 3;

and from 90 to 10% by weight of a component (b) which is selected from the group consisting of component (b-1), component (b-2) and combinations thereof, wherein component (b-1) is an alkenyl group-containing diorganopolysiloxane expressed by the average unit formula $$R^2_cSiO_{(4-c)/2},$$

in which $R^2$ denotes a monovalent hydrocarbon group, at least 5% by moles of the monovalent hydrogen groups denoted by $R^2$ being alkenyl groups, and c is a positive number from 1.95 to 2.02 inclusive, and component (b-2) is a resinous organopolysiloxane composed of the monofunctional organosiloxane units represented by the general formula $$R^3_3SiO_{0.5},$$

in which $R^3$ denotes a monovalent hydrocarbon group having from 1 to 6 carbon atoms, and the tetrafunctional siloxane units expressed by the formula $SiO_2$, the molar ratio of the monovalent organosiloxane units to the tetrafunctional siloxane units being in the range from 0.4:1 to 1.2:1.

2. A method for imparting water repellency to a woven fabric which comprises the steps of (i) applying to the woven fabric a silicone-based water-repellent agent comprising, as the silicone ingredient thereof, from 10 to 90% by weight of a component (a) which is an organohydrogenpolysiloxane containing, in a molecule, at least one organohydrogensiloxane unit represented by the general formula $$R^1_aH_bSiO_{(4-a-b)/2},$$

in which $R^1$ denotes a monovalent hydrocarbon group having from 1 to 30 carbon atoms, a is a number of 0, 1, or 2 and b is a number of 1 or 2 with the proviso that a+b is equal to 1, 2 or 3;

and from 90 to 10% by weight of a component (b) which is selected from the group consisting of component (b-1), component (b-2) and combinations thereof, wherein component (b-1) is an alkenyl group-containing diorganopolysiloxane expressed by the average unit formula $$R^2_cSiO_{(4-c)/2},$$

in which $R^2$ denotes a monovalent hydrocarbon group, at least 5% by moles of the monovalent hydrogen groups denoted by $R^2$ being alkenyl groups, and c is a positive number from 1.95 to 2.02 inclusive, and component (b-2) is a resinous organopolysiloxane composed of the monofunctional organosiloxane units represented by the general formula $$R^3_3SiO_{0.5},$$

in which $R^3$ denotes a monovalent hydrocarbon group having from 1 to 6 carbon atoms, and the tetrafunctional siloxane units expressed by the formula $SiO_2$, the molar ratio of the monovalent organosiloxane units to the tetrafunctional siloxane units being in the range from 0.4:1 to 1.2:1, and (ii) subjecting the woven fabric to a heat treatment.

3. The method as claimed in claim 2 wherein the monovalent hydrocarbon group denoted by $R^1$ is selected from the class consisting of methyl, ethyl, propyl, butyl, cyclopentyl, cyclohexyl, vinyl, allyl, phenyl, tolyl and benzyl groups.

4. The method as claimed in claim 2 wherein a is 1 and b is 1.

5. The method as claimed in claim 2 wherein the organohydrogenpolysiloxane has a linear molecular structure terminated at both molecular chain ends with trimethylsilyl groups.

6. The method as claimed in claim 2 wherein the organohydrogenpolysiloxane has a viscosity of at least 5 centistokes at 25° C.

7. The method as claimed in claim 2 wherein the alkenyl group in the component (b-1) is a vinyl group.

8. The method as claimed in claim 2 wherein the monovalent hydrocarbon group denoted by $R^3$ is selected from the class consisting of methyl, ethyl, propyl, butyl, vinyl, allyl and phenyl groups.

9. The method as claimed in claim 2 wherein the molar ratio of the monofunctional organosiloxane units to the tetrafunctional siloxane units in the component (b-2) is in the range from 0.5:1 to 0.8:1.

10. The method as claimed in claim 2 wherein the water-repellent agent comprises from 80 to 30% by weight of the component (a) and from 20 to 70% by weight of the component (b).

11. The method as claimed in claim 2 wherein the component (b) is a combination of from 10 to 40% by weight of the component (b-1) and from 90 to 60% by weight of the component (b-2).

12. The method is claimed in claim 2 wherein the water-repellent agent is an aqueous emulsion comprising the components (a) and (b).

13. The method as claimed in claim 2 wherein the water-repellent agent further comprises a metal salt of an organic acid.

14. The method as claimed in claim 13 wherein the amount of the metal salt of the organic acid is in the range from 2 to 10% by weight based on the total amount of the components (a) and (b).

15. The method as claimed in claim 2 wherein the heat treatment is carried out at a temperature from 150° to 180° C. for 1 to 3 minutes.

* * * * *